US009004596B2

(12) United States Patent
Barile, Jr. et al.

(10) Patent No.: US 9,004,596 B2
(45) Date of Patent: Apr. 14, 2015

(54) CHAIR WITH IMPROVED BACK SPRING

(75) Inventors: Peter W. Barile, Jr., Morristown, TN (US); Michael E. Saylor, Morristown, TN (US)

(73) Assignee: Daniel Paul Chairs, LLC, Morristown, TN (US)

( * ) Notice: Subject to any disclaimer, the term of this patent is extended or adjusted under 35 U.S.C. 154(b) by 309 days.

(21) Appl. No.: 13/276,424

(22) Filed: Oct. 19, 2011

(65) Prior Publication Data

US 2013/0099534 A1 Apr. 25, 2013

(51) Int. Cl.
*A47C 3/04* (2006.01)
*A47C 7/44* (2006.01)

(52) U.S. Cl.
CPC .. *A47C 3/04* (2013.01); *A47C 7/445* (2013.01)

(58) Field of Classification Search
USPC ..... 297/239, 291, 299, 297, 296, 285
See application file for complete search history.

(56) References Cited

U.S. PATENT DOCUMENTS 2,587,822 A * 3/1952 Corning ..... 403/220
2,981,319 A * 4/1961 Close ..... 297/451.1
5,039,163 A * 8/1991 Tolleson ..... 297/297
5,100,201 A * 3/1992 Becker et al. ..... 297/301.3
5,704,688 A * 1/1998 Schrewe et al. ..... 297/285
5,902,012 A * 5/1999 Han ..... 297/285
5,904,397 A 5/1999 Fismen
5,988,746 A * 11/1999 Raftery ..... 297/297
5,997,084 A * 12/1999 Barile et al. ..... 297/239
6,406,096 B1 * 6/2002 Barile, Sr. ..... 297/301.3
6,471,293 B2 10/2002 Ware et al.
6,679,551 B2 * 1/2004 Ware et al. ..... 297/239
6,820,934 B2 * 11/2004 Ware et al. ..... 297/285
6,896,327 B1 * 5/2005 Barile, Sr. ..... 297/297
7,021,712 B2 * 4/2006 Spendlove et al. ..... 297/285
8,388,064 B2 * 3/2013 Bertolini et al. ..... 297/299
2004/0026972 A1 * 2/2004 Spendlove ..... 297/299

* cited by examiner

*Primary Examiner* — David R Dunn
*Assistant Examiner* — Timothy J Brindley
(74) *Attorney, Agent, or Firm* — Pitts & Lake, P.C.

(57) ABSTRACT

Disclosed is a stackable chair containing a flexible back support frame mechanism that includes an improved spring system designed to allow reclining movement of a back support frame relative to a seat assembly. The back support frame and seat assembly are connected using right and left spring members disposed in a substantial surface-to-surface contact relationship with the seat assembly and back support frame members.

18 Claims, 6 Drawing Sheets

CHAIR WITH IMPROVED BACK SPRING

CROSS-REFERENCE TO RELATED APPLICATIONS

Not Applicable.

STATEMENT REGARDING FEDERALLY-SPONSORED RESEARCH OR DEVELOPMENT

Not Applicable.

BACKGROUND OF THE INVENTION

1. Field of Invention

The present invention relates generally to the field of moveable and stackable seating. More specifically, this invention relates to stackable chairs having a self-adjustable back support with an improved back spring.

2. Description of the Related Art

Prior chairs having a flexible backrest frame have provided frame members with spring members connected internal of seat tube members for control of movement of the backrest frame of the chair. A typical flexible backrest is illustrated in U.S. Pat. No. 5,039,163, issued to Tolleson, which discloses a chair including depending leg members and a hollow support frame having members with open ends terminating beneath the seat assembly of the chair. The chair includes a pair of hollow backrest frame members having open frame ends extending beneath the seat assembly for alignment with respective open ends of the support frame members. Each open end of the respective frame members includes at least one flexible spring member inserted therein. Prior configurations of spring members allow insertion of opposed spring member ends into opposed and aligned open frame ends, with each spring member being aligned with the frame ends and extended to fill any gap between the respective back frame members and support frame members. Therefore, replacement of the spring member required full disassembly of the chair frame and removal of each inserted spring member end. In order to prevent each spring element from excessive flexing during reclining movements of the chair backrest, the spring member ends have been typically enclosed by pairs of U-shaped brackets of metal that limit the range of angular movement of each enclosed spring member, thereby limiting the reclining movements of the chair backrest. Additional pairs of spring members and U-shaped brackets have been required to be added for rigorous use. The additional pairs of spring members are typically positioned parallel to each first set of spring members with associated enclosure by U-shaped brackets of greater width or depth, thereby requiring an increased width or depth of the support frame members to accommodate the additional spring members and brackets.

Another example of a prior art chair having a flexible backrest frame is illustrated in U.S. Pat. No. 6,896,327, issued to Barile, which discloses a stackable chair with a seat assembly and flexible back support having a seat spring system attached therebetween. The seat assembly includes seat sides having spaced apart rear portions. The back support includes lower ends curved forwardly and disposed in registry with and separated by right and left gaps from respective seat side rear portions. Right and left spring members are disposed inwardly adjacent to bridge each gap. Each spring member includes forward ends connected to respective right and left front support members extended inbound from respective seat sides, and includes rear ends connected to opposed ends of a frame rear cross-member. The spring members allow limited reclining movement of the back frame. A limit to excessive forward movement of the back support is provided by pairs of fixation plates positioned in aligned and abutting relationship on upper surfaces of each respective forward and rear ends of each spring member.

The prior art leaves a void for a stackable chair with a flexible back support frame employing a spring assembly attached directly to the exterior of the back support frame and seat assembly, thus eliminating additional cross structures or spring support members.

BRIEF SUMMARY OF THE INVENTION

The present invention, in some of its various embodiments, comprises a flexible back support frame mechanism for a stackable chair. The flexible back support frame mechanism includes an improved spring system designed to allow reclining movement of a back support frame while denying excessive forward movement of a back support relative to a seat assembly. The seat assembly includes right and left seat sides having spaced-apart rear portions. Right and left pairs of front and rear leg members are attached outboard of respective right and left seat sides, with each pair of leg members extended in spaced apart orientation to allow stacking with like-configured chair frames.

The back support frame includes frame lower ends curved forwardly and positioned in registry with and spaced apart by a gap separation from the rear portions of the seat assembly. Right and left spring members are superposed over each gap separation, with the rear end of each spring member secured in a substantial surface-to-surface contact relationship to the frame lower ends. Each spring member is extended a sufficient length to position a front end forward of each gap separation being secured in a substantial surface-to-surface contact relationship to respective right and left seat sides. This improved spring system dispenses with the need for additional spring support components that were previously required.

During reclining movement of the back support frame, the spring member rear ends are pivotably flexed downwardly to a flexed position. Each spring member is capable of repetitive flexing and includes an inherent bias to rebound to a non-flexed position, thereby returning the back support to a substantially upright position when not reclined by a seat occupant.

BRIEF DESCRIPTION OF THE DRAWINGS

The above-mentioned and additional features of the invention will become more clearly understood from the following detailed description of the invention read together with the drawings in which.

DETAILED DESCRIPTION OF THE INVENTION

Figure 1:
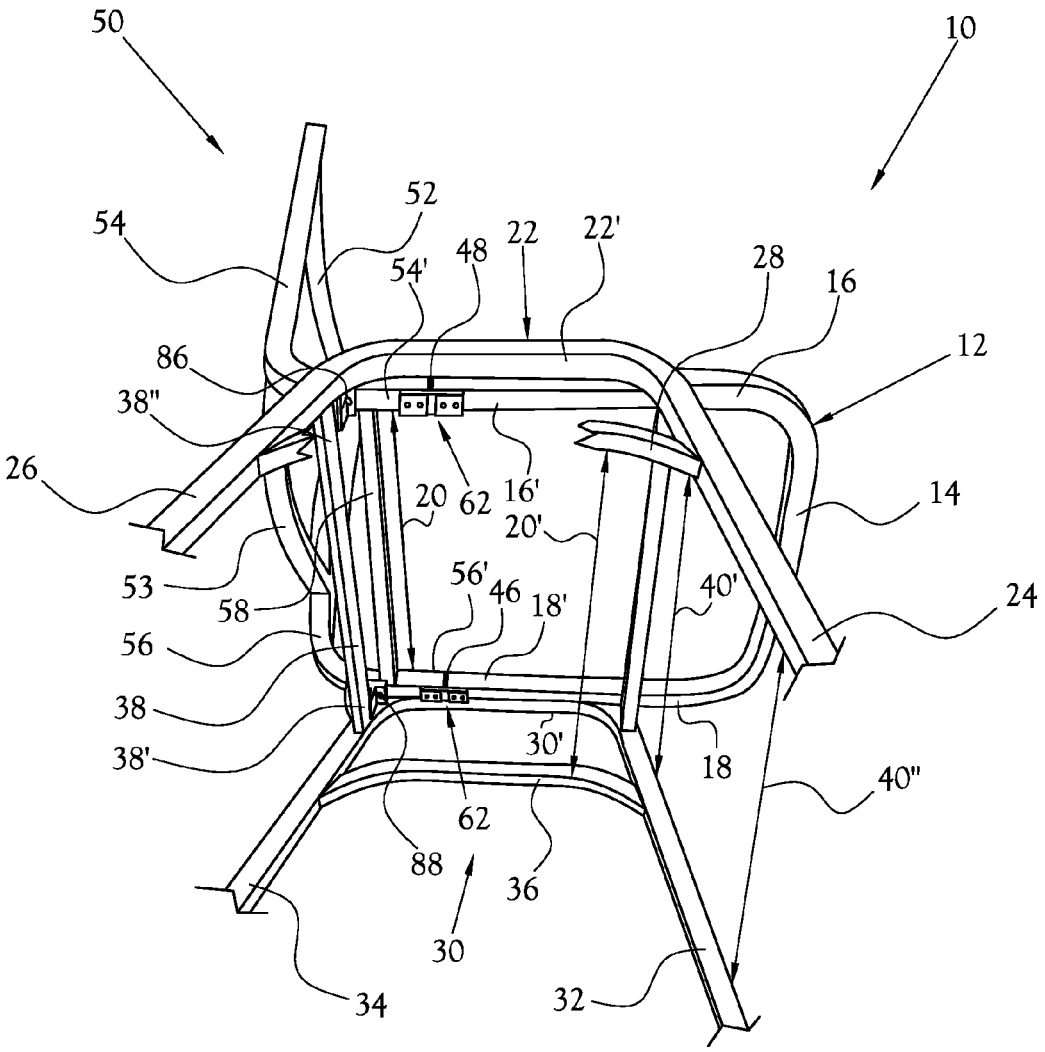
FIG. 1 illustrates a perspective view of one embodiment of the present invention.

A flexible back mechanism for stackable chairs is disclosed incorporating various features of the present invention for a stackable chair 10 as illustrated in FIGS. 1-7. The stackable chair 10 of the present invention is designed to provide a seat assembly 12 having a partially reclining back support frame 50 attached to rear portions of the seat assembly 12 by spring units 62. As illustrated in FIGS. 3A-3B, each right and left spring unit 62 includes a spring member 64 overlaid in a substantial surface-to-surface contact relationship with respective right and left sides of the seat assembly 12 and respective right and left lower portions of a back support frame 50 positioned proximal to rear portions of the seat assembly 12. The spring units 62 include unique features discussed hereinbelow for allowing the back support frame 50 to be reclined backwards within a limited range of motion, without the need for cross-member spring support structures that were necessary in the prior art.

For support of a removable seat cushion 90, the seat assembly 12 includes a front seat member 14 joined at opposed ends to a right seat member 16 and a left seat member 18. The right and left seat members 16, 18 extend rearward to right and left rear portions 16', 18' (see FIGS. 3A-3B), and are disposed in a substantially horizontal plane extending from the front seat member 14. The right and left rear portions 16', 18' are spaced apart in a generally parallel orientation and do not have a rear seat member extended to connect therebetween. The front, right and left seat members 14, 16, 18 can be any cross-sectional shape utilized for chair frames, including but not limited to cylindrical, oval or square in cross-section. The seat assembly 12 is connected to the back support frame 50 by spring members 64 overlaid in substantial surface-to-surface contact relationships with respective right and left seat member rear portions 16', 18' and right and left back support frame lower ends 54', 56'. The unique configuration of the seat spring system 60 negates a need for spring reinforcement cross-support members extended between seat members 16, 18, therefore a void space 20 exists between right and left spring units 62.

The seat assembly 12 is supported at a typical seating height above a supporting surface by a pair of right and left leg member units 22, 30 utilizing right front 24 and rear 26 legs, and left front 32 and rear 34 legs extending downwardly at respective forward and rearward angles. Each leg member unit 22, 30 includes an upper leg member support 22', 30' that is disposed in a substantially horizontal orientation parallel with, and joined outboard to the respective outer surfaces of the right and left seat members 16, 18.

The outboard positioning of the right and left leg member units 22, 30 facilitate generally vertical stacking of the chair 10 with like-configured chairs having similarly positioned leg member units disposed outboard of each seat assembly 12. In order to improve stability of the leg member units 22, 30, the front right and left legs 24, 32 can have an upper leg cross member 40 extended between the front legs 24, 32, and positioned below the front portions of respective right and left seat members 16, 18. The front legs 24, 32 can be angled laterally and outwardly to provide a lower leg width separation 40" greater than an upper leg width separation 40' to improve stability of the chair 10 (see FIG. 1). The rear legs 26, 34 have an upper rear cross-member, or restraint bar, 38 extended between upper portions of the rear legs 26, 34, thereby increasing rigidity of the rear leg members and also providing a stop mechanism for control of backwards pivoting of the back support frame 50 (discussed further hereinbelow).

Additional structural rigidity for the leg member units 22, 30 can be provided by a right lateral brace 28, and a left lateral brace 36, with each brace being extended between respective front and rear legs (see FIG. 1). The right lateral brace 28 and left lateral brace 36 are each positioned a spaced apart distance 20' below respective upper leg members 22', 30' (see FIG. 1). Upon stacking of like-configured chairs 10, the lower surface of each lateral brace 28, 36 will contact against the upper surface of the upper leg members of a like-configured seat assembly 12 having similar leg member units 22, 30 attached thereto. Therefore, the spaced apart distance 20' of the lateral braces below respective upper leg members 22', 30' of each chair will maintain the lower portions of the seat assembly 12 spaced apart from the upper surface of a seat cushion 90 of a like-configured chair during stacking of chairs 10, thereby minimizing wear on each seat cushion 90 when stacked. Further, if the lateral braces 28, 36 are attached sufficiently spaced below respective upper leg members 22', 30', the spaced apart distance 20' will allow the respective legs to be aligned but remain spaced apart from each other during stacking, thereby minimizing scraping and abrasion on the legs surfaces during storage and movement of stacked chairs.

A back support frame 50 is positioned to extend generally upright from the rear portions 16', 18' of the right and left seat members 16, 18. The back support frame 50 includes an upper portion 52 joined at opposed ends to right and left frame side members 54, 56 which are spaced apart by a sufficient width to accept a back support cushion 92 detachably connectable thereon (see FIG. 5). Each frame side member 54, 56 extends downwardly and is bent forwardly to form respective frame lower ends 54', 56' that extend forwardly to a generally horizontal orientation in aligned registry with and spaced apart from the seat member rear portions 16', 18'. Respective right and left frame lower ends 54', 56' are separated by gaps 46, 48 of approximately one eighth inch to approximately one quarter inch, from the respective seat member rear portions 16', 18' (see FIGS. 1-4). A back frame support cross-member 58 is attached between the back frame lower ends 54', 56' to increase rigidity of the back support frame 50.

As illustrated in FIGS. 1-4, the stackable chair 10 includes spring units 62 for connecting the lower ends of the back support frame 50 to the rear portions of the seat assembly 12. Each spring unit 62 includes right and left spring members 64 sized and secured to extend between the back support frame 50 and the seat assembly 12 in a configuration allowing the back support frame 50 to be reclined backwards in a limited range of motion while limiting excessive forward motion of the back support frame 50 relative to the seat assembly 12.

In order to provide a back support frame 50 that repetitively reclines and rebounds to a generally vertical position relative to the seat assembly 12, the opposed ends of each spring member 64 of spring units 62 are connected to respective bottom surfaces of the lower ends of the back support 50 and rear portions of the seat assembly 12. One skilled in the art will recognize that alternative positions of attachment can also be achieved. For instance, the spring members 64 can be connected to respective top surfaces of the lower ends of the back support 54', 56' and rear portions of the seat assembly 16', 18' without deviating from the present general inventive concept. Each spring member 64 includes a substantially planar and elongated body member having an adequate length to superpose respective left and right gap separations 46, 48 and overlap the back frame lower ends 54', 56' and respective rear seat portions 16', 18'.

Figure 2:
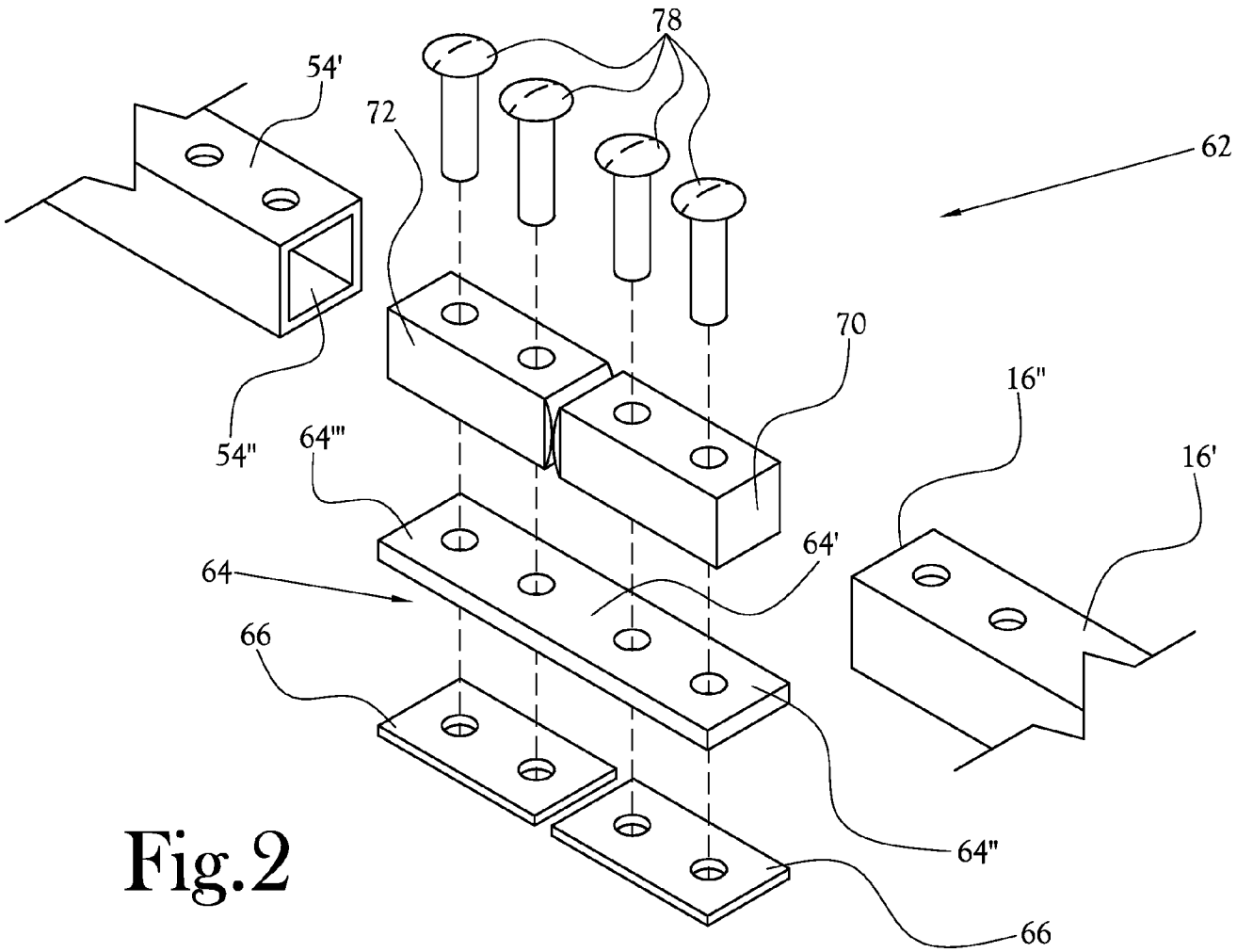
FIG. 2 illustrates a deconstructed view of one embodiment of the improved back spring.
Figure 3A:
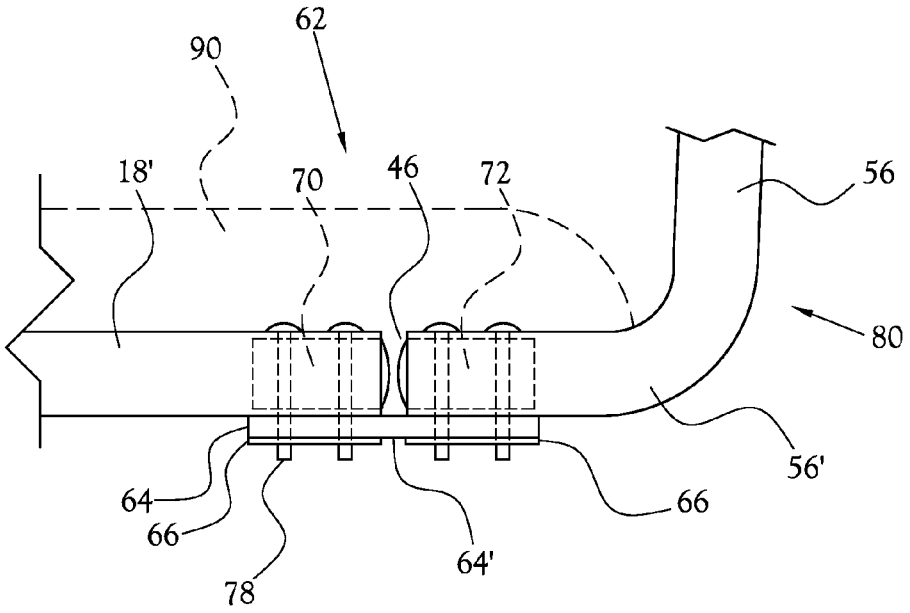
FIG. 3A illustrates a side view of one embodiment of the spring unit in the non-flexed position.
Figure 3B:
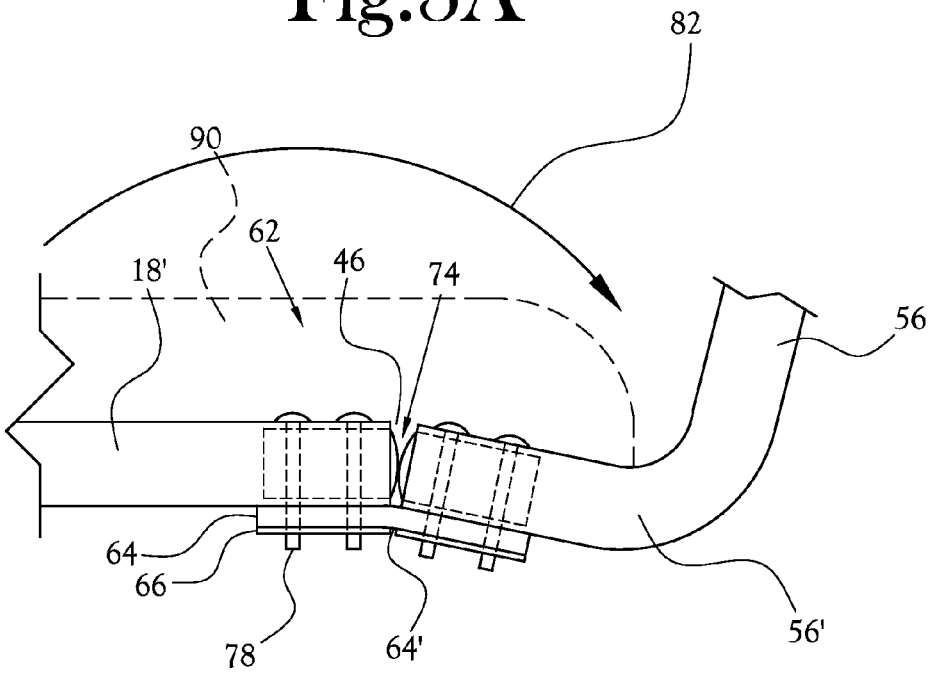
FIG. 3B illustrates a side view of one embodiment of the spring unit in the flexed position.
Figure 4:
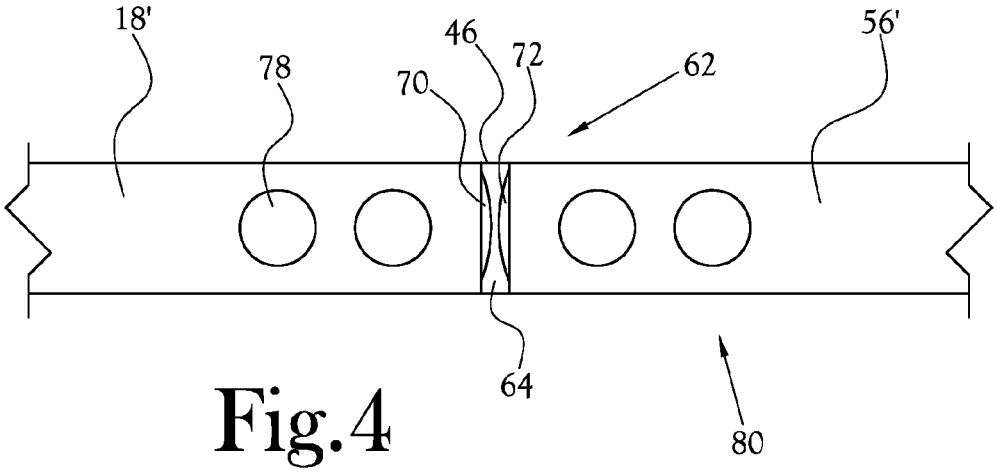
FIG. 4 illustrates a top view of one embodiment of the spring unit.
Figure 5:
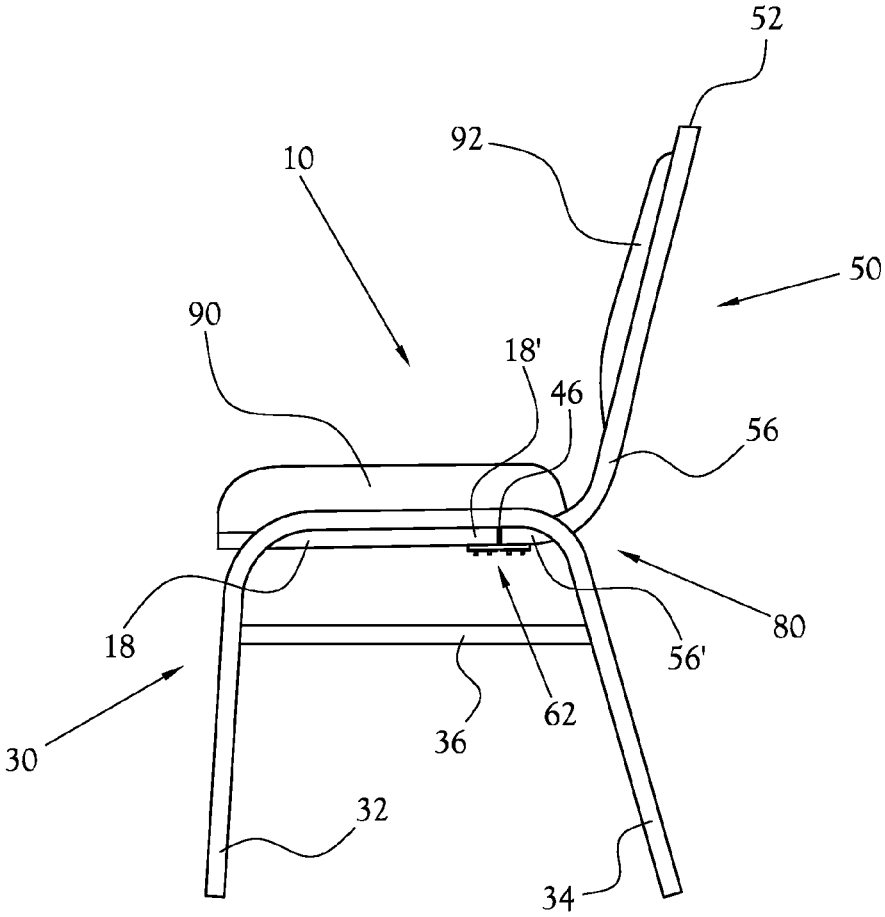
FIG. 5 illustrates a side view of one embodiment of the present invention in the non-flexed position.

One configuration of the spring member 64 includes a length in a range of about three inches to about four inches, having a forward portion 64" and a rear portion 64''' (see FIG. 2). The spring member 64 includes a width of approximately two inches, plus or minus an inch, and a depth of approximately one fourth of an inch. The overall depth of each spring unit 62, 62' can be readily doubled by stacking and securing opposed ends of stacked spring members 64 (not shown) to provide greater rigidity for the right and left spring units 62, 62' and providing a back support frame 50 less inclined to move rearward 82 (see FIG. 3B). A pivot point 64' for each spring member 64 is preferably centered at the mid-point of respective right and left gaps 46, 48, in order to allow the spring member rear portion 64''' to flex downwardly upon reclining movement of the back support frame 50. The spring member rear portion 64''' is extended distal of each gap 46, 48 to overlap with and detachably connect to a back frame lower end 54', 56'. Likewise, each spring member front portion 64" is extended distal of each gap 46, 48 to overlap with and detachably connect to a seat member rear portion 16', 18'.

The spring member material is preferably biased to return to a substantially horizontal, non-flexed position 80 for approximately 150,000 or more repetitions without failure. One embodiment of the spring member 64 includes generally rectangular exterior dimensions, a rectangular cross-section, and generally planar upper and lower surfaces to provide a compact cross sectional outline while maintaining the desired stiffness over the expected life of the stackable chair 10. One skilled in the art will recognize that alternative cross-sectional outlines can be utilized such as an elongated spring member having a flattened oval cross-section, with generally planar upper and lower surfaces. Each spring member rear portion 64''' is positioned to rotate downwardly during flexing to a flexed position 82 (see FIG. 3B). Maintenance to the spring member 64 can be readily provided by detachment of the spring member 64 and installation of a plurality of stacked spring members 64, and/or installation of a more rigid or less rigid spring member in each spring unit 62, 62.

To accommodate the spring units 62, the right and left seat member rear portions 16', 18' each contain a hollow cavity 16", 18" (see FIG. 2), in order to house a solid support insert 70. Each solid support insert 70 includes generally cubical exterior dimensions with two ends and a square cross section. One skilled in the art will recognize that alternative cross-sectional outlines can be utilized. One end of the solid support insert 70 is convexly shaped and positioned in aligned registry with and spaced apart from the right and left back frame side lower ends 54', 56'. Likewise, the right and left back frame side lower ends 54', 56' are also hollow to house a solid support insert 72 having like dimensions as the seat member rear portion inserts 70. The convexly shaped end of each back support frame lower end support insert is positioned in aligned registry with and spaced apart from the right and left seat member rear portions 16', 18' and the seat member rear portion support inserts 70 (see FIGS. 2-4). The convexly shaped ends of each solid support insert 70, 72 are designed to engage one another during the reclining of the back frame so as to minimize undesirable sounds and damage to the seat assembly 12 and back frame 50 members. When the back support frame 50 is reclined 82 (see FIG. 3B), each convexly shaped end of the solid support inserts 70, 72 form an abutting relationship 74 that facilitates rubbing against one another in a manner so as to not damage the seat assembly 12 or back support 50 frame members.

Each solid support insert 70, 72 is further designed to provide structural support for each seat assembly 12 and back frame 50 member. Referring to FIG. 2, each spring member front portion 64" is secured to the bottom surface of respective right and left seat member rear portions 16', 18' by removable connectors 78. In the illustrated embodiment, the removable connectors 78 include high strength steel rivets. However, one of skill in the art will immediately recognize that the specific shape and composition of the removable connectors 78 can be substituted or modified without departing from the scope or spirit of the present general inventive concept. Each removable connector 78 penetrates respective right and left seat member rear portions 16', 18', seat member rear portion solid support inserts 70, as well the spring members 64. Similarly, each spring member rear portion 64''' is secured to the bottom surface of respective right and left back support frame side lower ends 54', 56' by removable connectors 78. Each removable connector 78 penetrates the respective right and left back support frame side lower ends 54', 56, back frame lower end support inserts 72, as well as the spring member 64. The removable connectors 78 also prevent lateral movement or slippage of both the spring member front and rear portions 64", 64", with respect to the seat member rear portions 16', 18', and the back support frame lower ends 54', 56'.

Figure 6:
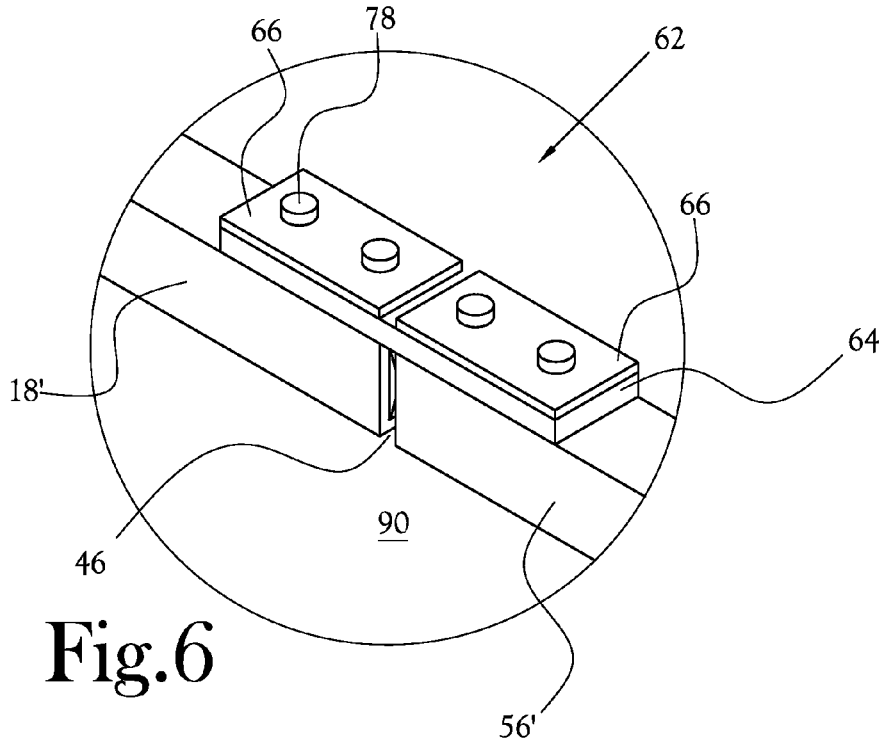
FIG. 6 illustrates a bottom view of one embodiment of the spring unit in the non-flexed position.

Additionally, superposed underneath each spring member front portion 64" and rear portion 64", and also penetrated by removable connectors 78, is a square washer 66 to facilitate receiving and securing the removable connectors 78 (see FIGS. 2, 6). A pivot point 64' of each spring member 64 is preferably positioned in between each square washer 66. In another non-illustrated embodiment, channel shaped washers are used in lieu of square washers 66. One of skill in the art will recognize that the specific shape of the washers may be modified without departing from the scope or spirit of the present general inventive concept.

One of skill in the art will recognize that other objects can be interposed between the spring member 64 and the seat member rear portions 16', 18' and back support frame lower ends 54', 56'. For instance, an object having similar dimensions to the square washers 66 can be interposed between each spring member portion 64", 64''' and the seat member rear portions 16', 18' and back support frame lower ends 54', 56' and not compromise the spirit of the present general inventive concept. The spring member 64 will still be overlaid in a substantial surface-to-surface contact relationship with the seat member rear portions 16', 18' and back support frame lower ends 54', 56'. Likewise, interposing a flexible component that spans substantially the length of the spring member 64 can also be included, as long as such component is flexible to facilitate flexing of the spring member 64 and reclining of the back support frame 50.

Figure 8:
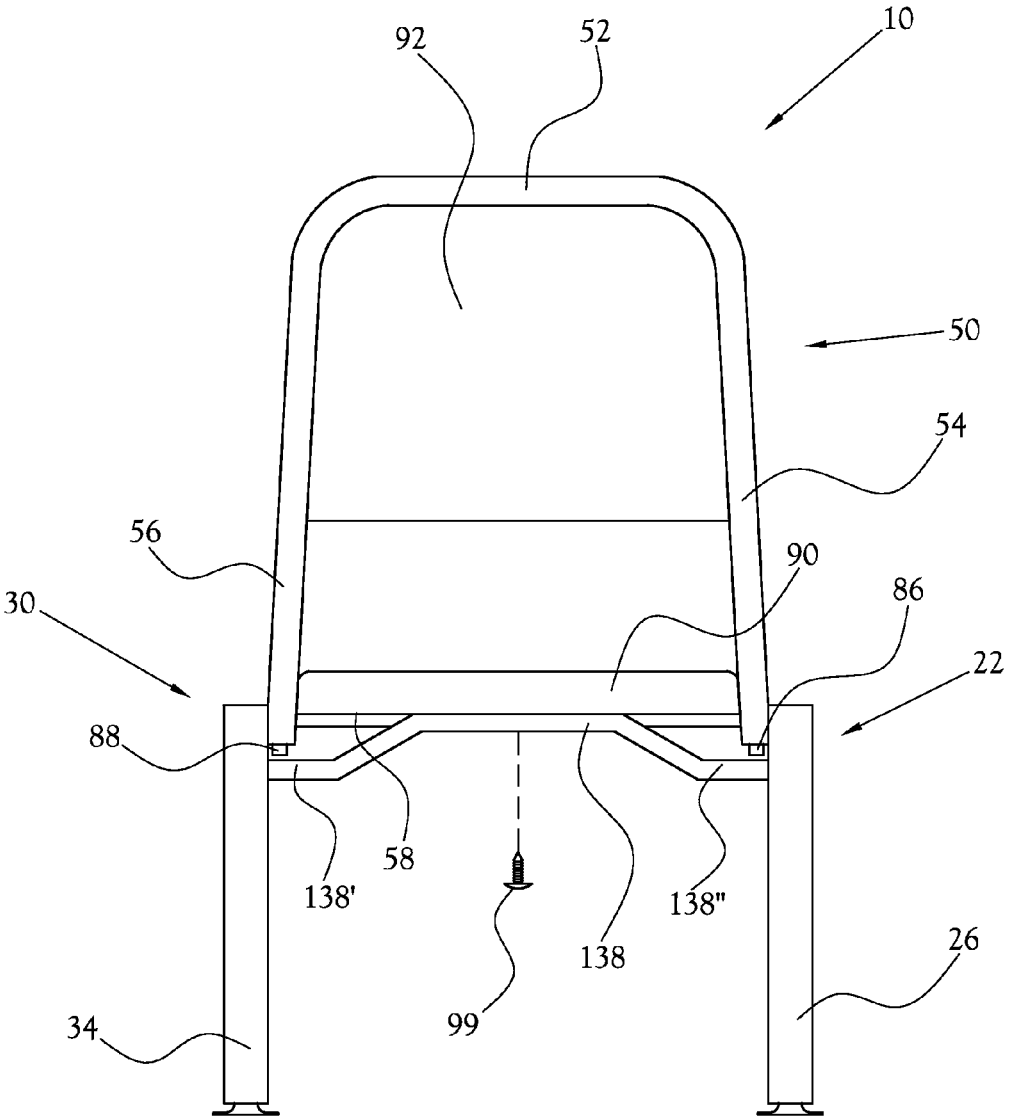
FIG. 8 illustrates a rear view of one embodiment of the present invention having an upward-shaped rear restraint bar.

A back frame stop mechanism can be incorporated to prevent excessive backwards flexing 82 of the back support frame 50. A rear leg restraint bar 38 is extended to join at opposed ends 38', 38" between upper portions of the rear legs 26, 34, as illustrated in FIG. 1. An upper surface of the opposed ends of the rear restraint bar 38 is positioned about one inch, plus or minus one quarter inch, below the lower surfaces of respective right and left frame lower ends 54', 56'. Turning briefly to FIG. 8, an alternate embodiment of the rear restraint bar 138 is shown where the opposed ends 138', 138" remain perpendicularly joined to the upper portions of the rear legs 26, 34, but the middle portion of the rear restraint bar 138 is curved or shaped upward in a sufficient dimension so as to contact the rear portion of the seat cushion 90. The seat cushion 90 can then be attached to the upward dimension of the restraint bar 138 using a screw 99 or like connector. One skilled in the art will recognize that alternate shapes and configurations of the rear restraint bar 38, 138 can be selected without departing from the scope or spirit of the present general inventive concept.

A right stop guard 86 and a left stop guard 88 are attached to the lower surfaces of respective right and left frame lower ends 54', 56'. The stop guards 86, 88 can be composed of a high density plastic material, a molded polypropylene material, other similar synthetic polymers or a rubber material. Each stop guard 86, 88 is positioned on lower surfaces of respective frame lower ends 54', 56' to allow contact by each stop guard 86, 88 against the upper surface of the rear restraint bar 38, 138 when the back frame sides 54, 56 are moved rearward 82 by force applied against the back support frame 50. The stop guards 86, 88 are shaped to extend downwardly about a half-inch from the lower surfaces of the right and left frame lower ends 54', 56', with preferably an inverted "U" shaped configuration to provide an encircling contact by each stop guard with the rear restraint bar 38, 138 as the right and left frame lower ends 54', 56' are moved downwardly. Alternate shapes and thicknesses can be selected for the stop guards in order to limit the maximum downwards movement of the respective right and left frame lower ends 54', 56' to about a half-inch of motion. Resulting reclining of the back support frame 50 and downwards flexing of the spring member rear portion 64''' is limited to about a half-inch. One skilled in the art will readily recognize that the shape of the stop guards 86, 88, the position of the rear restraint bar 38, 138 and the range of extension below the frame lower ends 54', 56' can be altered to provide for greater or lesser reclining movement 82 of the back support frame 50. The stop members 86, 88 prevent excessive backwards reclining of the back support frame 50, thereby limiting the flexing motion of each spring member 64 in order to minimize breakage or fracture of either spring member 64.

A forward stop mechanism is provided by the improved spring member 64. The improved spring member is biased to return to non-flexed position 80 after reclining. Whereas the weight of an occupant will provide sufficient force to flex the spring member 64 and facilitate the back support member 50 moving to a reclined position 82, the rebound action of the occupant removing their weight from the back support frame 50 will not provide enough force to rebound the back support frame 50 substantially past the non-flexed position 80 into a forward, hyper-extended position (not illustrated). Further, the back frame support cross-member 58 will contact the lower surface of the seat cushion 90 if the back frame is flexed substantially forward, thereby also preventing hyper-extension.

Figure 7:
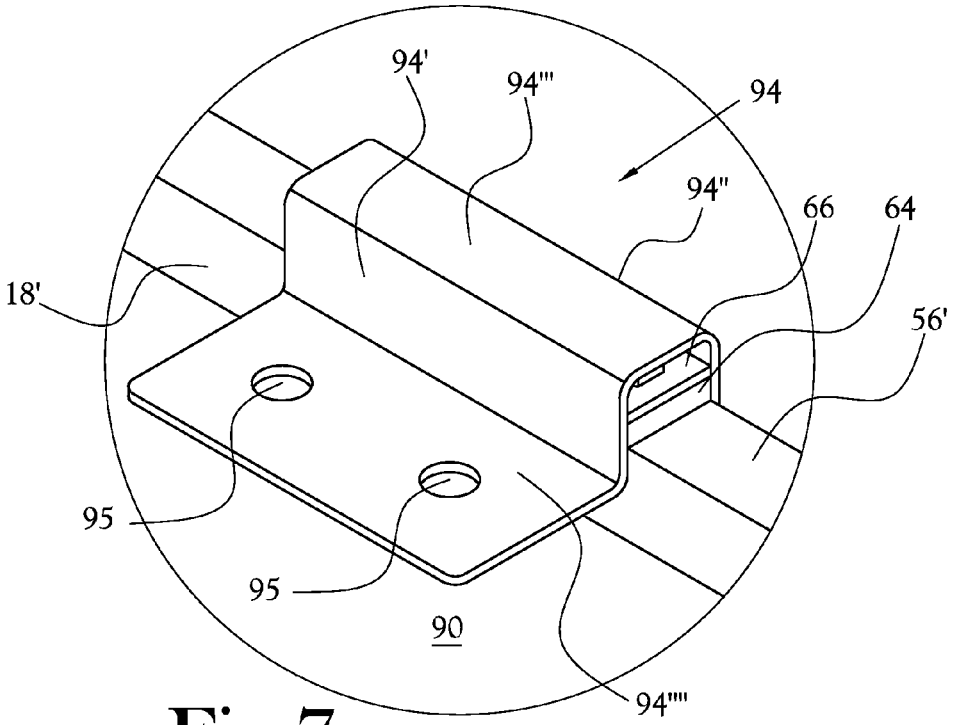
FIG. 7 illustrates a bottom view of one embodiment of the spring unit in the non-flexed position with a cover guard installed.

As illustrated in FIGS. 6-7, a flexible cover guard 94 is removably installed underneath and in a covering relationship for each respective gap 46, 48 and each spring unit 62. Each cover guard 94 includes a generally U-shaped profile with a connecting panel 94'''' extending off one side. Stated differently, each cover guard 94 has a right panel 94'' in a covering relationship with the outboard side of the back support frame lower ends 54', 56', seat member rear portions 16', 18', and spring units 62; a left panel 94' in a covering relationship with the inboard side of the back support frame lower ends 54', 56', seat member rear portions 16', 18', and spring units 62; a bottom panel 94''' connecting the right and left panels 94'', 94' and in a covering relationship with the bottom surface of the back support frame lower ends 54', 56', seat member rear portions 16', 18', and spring units 62; and a connecting panel 94'''' extending distal the U-shaped profile and removably attached to the bottom of the seat cushion 90. Each connecting panel 94'''' has attachment holes to receive screws, rivets, or the like so as to secure the connecting panel 94'''' against the bottom surface of the seat cushion 90.

Alternative embodiments for the spring units 62 include a plurality of spring members 64 stacked and aligned on each other, thereby increasing the rigidity of each spring units 62. Alternative spring members include planar spring members having a plurality of widths, thicknesses, or lengths depending on the design of the stackable chair and the weights of the occupants predicted to be supported by the back support frame 50 during repetitive reclining movements. Each spring member 64 is composed of substantially stiff material, such as one example including layered fiberglass, which is capable of being repetitively flexed along a length dimension without failure. The chemical composition of each spring member 64 can be modified for production of a spring member having greater or lesser flexibility.

While the present invention has been illustrated by description of some embodiments, and while the illustrative embodiments have been described in detail, it is not the intention of the applicant to restrict or in any way limit the scope of the appended claims to such detail. Additional modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A stackable chair, comprising:

a seat assembly including right and left seat members having spaced apart rear portions;

a right and left pair of front and rear leg members supporting said seat assembly and joined outboard of respective seat members to facilitate stacking on a like-configured seat assembly;

a back support, including spaced apart right and left side support members, said right and left side support members extending downwardly to respective right and left lower ends curved forwardly to be positioned in registry with and spaced apart by right and left gap separations from respective seat member rear portions; and a right and left spring member being separately superposed over respective right and left gap separations, each spring member having a rear portion secured in a substantial surface-to-surface contact relationship with respective right and left back support lower ends, and a front portion secured in a substantial surface-to-surface contact relationship with said right and left seat member rear portions, each spring member being biased to return to a non-flexed position;

whereby said back support is reclined when sufficient force is applied against said back support to pivot said spring member rear portions downwardly to a flexed position, said back support being returned to a substantially upright position relative to said seat assembly by each spring member being biased to return to the non-flexed position;

wherein said right and left back support lower ends and said right and left seat member rear portions are hollow having generally cubical exterior dimensions and a generally square cross section insert housed inside, said inserts having a convexly shaped end positioned in aligned registry with and spaced apart from respective said back support lower ends and seat member rear portions such that said convexly shaped ends of said seat member rear portion inserts face said convexly shaped ends of said back support lower end inserts, and said convexly shaped ends having convex portions which extend continuously across the entirety of the square cross section insert, whereby upon reclining of said back support, said seat member rear portion inserts engage with said back support lower end inserts and wherein the convexly shaped ends form an abutting relationship that facilitates rubbing against one another.

2. The stackable chair in claim 1, wherein said right and left pairs of leg members including a right and left side reinforcement member extended between each front and rear leg member, each respective side reinforcement member is aligned parallel with and spaced apart below respective right and left seat members.

3. The stackable chair of claim 1, further comprising:

a seat cushion removably connected to be supported on said seat assembly, said seat cushion having a sufficient width to extend between said right and left seat members and having a sufficient length to cover said back support lower ends positioned in registry with and spaced apart by said right and left gap separations from respective seat member rear portions, whereby said gap separations are covered by said seat cushion thereby negating access from above said seat cushion during repetitive reclining movements of said back support relative to said seat assembly; and a back support cushion removably connected to be supported by said back support, said back support cushion including a sufficient width to extend between said right and left side support members and having a sufficient length for support of a seated occupant during repetitive reclining movements of said back support relative to said seat assembly.

4. The stackable chair of claim 1 wherein said right and left spring members are substantially planar along a length dimension.

5. The stackable chair of claim 1 wherein said seat assembly rear portions have at least a top surface and a bottom surface, said right and left back support lower ends having at least a top surface and a bottom surface, said right and left spring members being separately superposed over respective right and left gap separations, each spring member having a rear portion secured in a substantial surface-to-surface contact relationship with said bottom surface of respective right and left back support lower ends, and a front portion secured in a substantial surface-to-surface contact relationship with said bottom surface of said right and left seat member rear portions.

6. The stackable chair of claim 5, further comprising:

a right and left cover guard removably positioned underneath each respective gap separation and spring member in a covering relationship of each respective gap separation and spring member, each cover guard is composed of pliable material readily bendable during repetitive movement of said spring members between the non-flexed position to the flexed position, whereby said cover guards substantially prevent finger intrusion into either gap separation during repetitive reclining movements of said back support relative to said seat assembly.

7. The stackable chair of claim 1, further comprising:

a back frame support cross member joined to respective back support frame lower ends and disposed in a substantially horizontal plane with said seat members.

8. A stackable chair, comprising:

a seat assembly including right and left seat members having spaced apart rear portions, said right and left seat members being disposed in a substantially horizontal plane for placement of a removable seat cushion thereon;

a right and left pair of front and rear leg members supporting said seat assembly and joined outboard of respective seat members to facilitate stacking on a like-configured seat assembly;

a back support including spaced apart right and left frame members extending to respective right and left frame lower ends curved forwardly to be positioned in registry with and spaced apart by a gap separation from said rear portions of said right and left seat members;

a back frame support cross member joined to respective back support frame lower ends and disposed in a substantially horizontal plane with said seat members; and a right and left spring member separately superposed over respective right and left gap separations, each spring member having a rear portion secured in a substantial surface-to-surface contact relationship with respective right and left frame lower ends, each spring member having a front portion extended and secured in a substantial surface-to-surface contact relationship with each rear portion of said right and left seat members, each spring member is biased to a non-flexed position;

whereby upon said back support being moved to a reclined position, said right and left spring members are flexed to a flexed position with respective spring member rear portions moved downwardly, and upon said back support being moved to a substantially upright position upon removal of induced reclining movement of said back support, said right and left spring members return to their biased, non-flexed position;

wherein said right and left back support lower ends and said right and left seat member rear portions are hollow having generally cubical exterior dimensions and a generally square cross section insert housed inside, said inserts having a convexly shaped end positioned in aligned registry with and spaced apart from respective said back support lower ends and seat member rear portions such that said convexly shaped ends of said seat member rear portion inserts face said convexly shaped ends of said back support lower end inserts, and said convexly shaped ends having convex portions which extend continuously across the entirety of the square cross section insert, whereby upon reclining of said back support, said seat member rear portion inserts engage with said back support lower end inserts and wherein the convexly shaped ends form an abutting relationship that facilitates rubbing against one another.

9. The stackable chair of claim 8, wherein said right and left spring members having generally planar upper and lower surfaces and are composed of material biased to rebound to said non-flexed position.

10. The stackable chair of claim 8 wherein said seat member rear portions have at least a top surface and a bottom surface, said right and left back support lower ends having at least a top surface and a bottom surface, said right and left spring members being separately superposed over respective right and left gap separations, each spring member having a rear portion secured in a substantial surface-to-surface contact relationship with said bottom surface of respective right and left back support lower ends, and a front portion secured in a substantial surface-to-surface contact relationship with said bottom surface of said right and left seat member rear portions.

11. The stackable chair of claim 10, further comprising:

a right and left cover guard removably positioned underneath each respective gap separation and spring member in a covering relationship of each respective gap separation and spring member, each cover guard is composed of pliable material readily bendable during repetitive movement of said spring members between the non-flexed position to the flexed position, whereby said cover guards substantially prevent finger intrusion into either gap separation during repetitive reclining movements of said back support relative to said seat assembly.

12. A stackable chair comprising:

a seat assembly including a front seat member joined to right and left seat members having spaced apart rear portions, said seat assembly disposed in a substantially horizontal plane to receive a seat cushion thereon, said seat member rear portions being hollow and containing a generally square cross section solid support insert housed inside the cavity of said right and left seat member rear portions, said insert having a rearward facing convexly shaped end, with a convex portion that extends continuously across the entirety of the square cross section insert, in aligned registry with and spaced apart from respective seat member rear portions;

a pair of right and left inverted U-shaped leg members supporting said seat assembly, each pair of leg members having right and left upper leg segments joined outboard of respective right and left seat members;

a back support frame including spaced apart right and left frame members upstanding relative to the pair of seat support frame members, each right and left frame member having a lower end curved forwardly and disposed in registry behind said right and left seat members rear portions, said lower ends of said frame members being positioned in spaced apart alignment across respective right and left gap separations from respective right and left seat members, said back support frame lower ends being hollow and containing a generally square cross section solid support insert housed inside the cavity of said right and left back support frame lower ends, said support insert having a convexly shaped end, with a convex portion that extends continuously across the entirety of the square cross section insert, in aligned registry with and spaced apart from respective back support frame lower ends and facing said seat member rear portions;

a back frame support cross member joined to respective back support frame lower ends and disposed in a substantially horizontal plane with said seat members;

a right and left spring member positioned for bridged extension overlapping said right and left frame member lower ends and said rear portions of said right and left seat members, each spring member having a front end in a substantial surface-to-surface contact relationship with respective rear portions of said seat members, and having a rear end in a substantial surface-to-surface contact relationship with respective frame member lower ends;

whereby upon said back support being moved to a reclined position, said right and left spring members are flexed to a flexed position with respective spring member rear portions moved downwardly, and upon said back support being moved to a substantially upright position upon removal of induced reclining movement of said back support, said right and left spring members return to their biased, non-flexed position, wherein the convexly shaped ends form an abutting relationship that facilitates rubbing against one another.

13. The stackable chair of claim 12 wherein said seat member rear portions have at least a top surface and a bottom surface, said right and left back support lower ends having at least a top surface and a bottom surface, said right and left spring members being separately superposed over respective right and left gap separations, each spring member having a rear portion secured in a substantial surface-to-surface contact relationship with said bottom surface of respective right and left back support lower ends, and a front portion secured in a substantial surface-to-surface contact relationship with said bottom surface of said right and left seat member rear portions.

14. The stackable chair of claim 13, further comprising:

a right and left cover guard removably positioned underneath each respective gap separation and spring member in a covering relationship of each respective gap separation and spring member, each cover guard is composed of pliable material readily bendable during repetitive movement of said spring members between the non-flexed position to the flexed position, whereby said cover guards substantially prevent finger intrusion into either gap separation during repetitive reclining movements of said back support relative to said seat assembly.

15. The stackable chair of claim 12, further comprising:

a rear restraint bar connected between respective right and left rear leg members and positioned proximally beneath said frame member lower ends, whereby when said back support frame is reclined with resulting flexing downwardly of said spring member rear portion ends, said frame member lower ends are contacted against said rear restraint bar whereby reclining movement is limited for said back support frame.

16. The stackable chair of claim 15, wherein said rear restraint bar is perpendicularly connected to said right and left rear leg members and includes a middle portion shaped upward in a sufficient dimension so as to contact the rear portion of the seat cushion.

17. The stackable chair of claim 12, wherein said right and left spring members having generally planar upper and lower surfaces and having a depth between said upper and lower surfaces being composed of material biased to rebound to a non-flexed position for said upper and lower surfaces whereby said back support frame is returned to a substantially upright position after each reclining movement of said back support frame.

18. The stackable chair of claim 12, wherein said right and left pair of front and rear leg members including: a right side lateral brace extended between respective right front and right rear leg members, said right side lateral brace disposed generally parallel below said right upper leg segment; and a left side lateral brace extended between respective left front and left rear leg members, said left side lateral brace disposed generally parallel below said left upper leg segment.

* * * * *